US010895819B2

(12) United States Patent
Nishimura

(10) Patent No.: US 10,895,819 B2
(45) Date of Patent: Jan. 19, 2021

(54) IMAGE FORMING DEVICE, IMAGE DENSITY STABILIZATION CONTROL METHOD, AND RECORDING MEDIUM

(71) Applicant: SHARP KABUSHIKI KAISHA, Sakai (JP)

(72) Inventor: Yasuhiro Nishimura, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 16/507,608

(22) Filed: Jul. 10, 2019

(65) Prior Publication Data

US 2020/0019081 A1 Jan. 16, 2020

(30) Foreign Application Priority Data

Jul. 12, 2018 (JP) ..... 2018-132626

(51) Int. Cl.
*G03G 15/043* (2006.01)
*G03G 15/02* (2006.01)
*G03G 21/20* (2006.01)

(52) U.S. Cl.
CPC ..... *G03G 15/043* (2013.01); *G03G 15/0266* (2013.01); *G03G 21/203* (2013.01)

(58) Field of Classification Search
CPC .. G03G 15/043; G03G 15/0266; G03G 21/20; G03G 21/203
See application file for complete search history.

(56) References Cited

U.S. PATENT DOCUMENTS 5,708,915 A * 1/1998 Noguchi ..... G03G 15/0266 399/49
5,749,022 A * 5/1998 Kikui ..... G03G 15/0266 361/225
2008/0298826 A1* 12/2008 Yonekubo ..... G03G 15/0266 399/44

FOREIGN PATENT DOCUMENTS

JP 2001-228657 A 8/2001

* cited by examiner

*Primary Examiner* — Carla J Therrien
(74) *Attorney, Agent, or Firm* — ScienBiziP, P.C.

(57) ABSTRACT

An image forming device is provided that more effectively reduces changes in the image density caused by reductions in the charged potential immediately after the application of charge to a photosensitive body, including: a photosensitive body; a charger that charges the photosensitive body; a charged potential fluctuation prediction unit that predicts an amount of fluctuation in a charged potential of the photosensitive body; an optical scanning device that irradiates the photosensitive body with an exposure laser and forms an electrostatic latent image; a development device that develops the electrostatic latent image; and an exposure laser output correction unit that corrects an output of the exposure laser. The charged potential fluctuation prediction unit predicts an amount of fluctuation in the charged potential from a charging stop time, and the exposure laser output correction unit reduces a change in density of the image caused by a fluctuation in the charged potential.

8 Claims, 13 Drawing Sheets

FIG. 6

| PHASE | CUMULATIVE TIME SINCE START OF CHARGING (milliseconds) | BASIC CORRECTION AMOUNT Re_mul | | |
|---|---|---|---|---|
| | | 100 (mm/second) | 200 (mm/second) | 300 (mm/second) |
| 1 | 0 ~ 80 | 5 | 10 | 15 |
| 2 | 80 ~ 160 | 5 | 10 | 15 |
| 3 | 160 ~ 240 | 5 | 10 | 15 |
| 4 | 240 ~ 320 | 4 | 9 | 13 |
| 5 | 320 ~ 400 | 4 | 8 | 12 |
| 6 | 400 ~ 480 | 4 | 7 | 11 |
| 7 | 480 ~ 560 | 3 | 6 | 9 |
| 8 | 560 ~ 640 | 3 | 5 | 8 |
| 9 | 640 ~ 720 | 2 | 5 | 7 |
| 10 | 720 ~ 800 | 2 | 5 | 7 |
| 11 | 800 ~ 880 | 2 | 5 | 7 |
| 12 | 880 ~ 960 | 2 | 4 | 6 |
| 13 | 960 ~ 1040 | 2 | 4 | 6 |
| 14 | 1040 ~ 1120 | 2 | 4 | 6 |
| 15 | 1120 ~ 1200 | 2 | 3 | 5 |
| 16 | 1200 ~ 1280 | 2 | 3 | 5 |
| 17 | 1280 ~ 1360 | 2 | 3 | 5 |
| 18 | 1360 ~ 1440 | 1 | 3 | 4 |
| 19 | 1440 ~ 1520 | 1 | 3 | 4 |
| 20 | 1520 ~ 1600 | 1 | 3 | 4 |
| 21 | 1600 ~ 1680 | 1 | 2 | 3 |
| 22 | 1680 ~ 1760 | 1 | 2 | 3 |
| 23 | 1760 ~ 1840 | 1 | 2 | 3 |
| 24 | 1840 ~ 1920 | 1 | 1 | 2 |
| 25 | 1920 ~ 2000 | 1 | 1 | 2 |
| 26 | 2000 ~ 2080 | 1 | 1 | 2 |
| 27 | 2080 ~ 2160 | 0 | 1 | 1 |
| 28 | 2160 ~ 2240 | 0 | 1 | 1 |
| 29 | 2240 ~ 2320 | 0 | 1 | 1 |
| 30 | 2320 ~ 2400 | 0 | 0 | 0 |

FIG. 7A $$\text{PHASE} = 13 - \left[\frac{1}{10} \times \begin{array}{c}\text{TIME LEFT}\\ \text{STANDING}\\ \text{(SECONDS)}\end{array}\right]$$

FIG. 7B

| CHARGING STOP TIME | RESTART PHASE | k_ti |
|---|---|---|
| AT LEAST 10 SECONDS BUT LESS THAN 120 SECONDS | CALCULATE RESTART PHASE FROM EQUATION IN FIG. 7(A) | 1.0 |
| AT LEAST 120 SECONDS BUT LESS THAN 600 SECONDS | RESTART FROM PHASE 1 | 1.1 |
| AT LEAST 10 MINUTES BUT LESS THAN 60 MINUTES | | 1.2 |
| AT LEAST 1 HOUR BUT LESS THAN 2 HOURS | | 1.3 |
| AT LEAST 2 HOURS BUT LESS THAN 24 HOURS | | 1.2 |
| AT LEAST 24 HOURS BUT LESS THAN 48 HOURS | | 1.1 |
| 48 HOURS OR MORE | | 1.0 |

FIG. 8

| CHARGING CONTROL TIME PROPORTION OF PHOTOSENSITIVE DRUM | | | CORRECTION COEFFICIENT KL_X DETERMINED ACCORDING TO FILM THICKNESS LOSS CORRECTION COUNT OF PHOTOSENSITIVE DRUM |
|---|---|---|---|
| 0 | ~ | 5 | 1.0 |
| 5 | ~ | 10 | 1.1 |
| 10 | ~ | 15 | 1.3 |
| 15 | ~ | 20 | 1.5 |
| 20 | ~ | 25 | 1.5 |
| 25 | ~ | 30 | 1.3 |
| 30 | ~ | 35 | 1.2 |
| 35 | ~ | 40 | 1.1 |
| 40 | ~ | 45 | 1.1 |
| 45 | ~ | 50 | 1.1 |
| 50 | ~ | 55 | 1.1 |
| 55 | ~ | 60 | 1.1 |
| 60 | ~ | 65 | 1.1 |
| 65 | ~ | 70 | 1.1 |
| 70 | ~ | 75 | 1.1 |
| 75 | ~ | 80 | 1.1 |
| 80 | ~ | 85 | 1.1 |
| 85 | ~ | 90 | 1.1 |
| 90 | ~ | 95 | 1.1 |
| 95 | ~ | 100 | 1.1 |

FIG. 9

| | | TEMPERATURE (° C) | | | | | | | |
|---|---|---|---|---|---|---|---|---|---|
| | | ~5 | ~10 | ~15 | ~20 | ~25 | ~30 | ~35 | 35~ |
| RELATIVE HUMIDITY (%) | ~10 | 1 | 1 | 1 | 1 | 1 | 2 | 2 | 2 |
| | ~20 | 1 | 1 | 1 | 2 | 2 | 3 | 4 | 4 |
| | ~30 | 1 | 1 | 2 | 2 | 3 | 4 | 5 | 5 |
| | ~40 | 1 | 2 | 2 | 3 | 4 | 5 | 6 | 6 |
| | ~50 | 2 | 2 | 3 | 3 | 4 | 6 | 7 | 7 |
| | ~60 | 2 | 2 | 3 | 4 | 5 | 6 | 8 | 8 |
| | ~70 | 2 | 3 | 3 | 4 | 5 | 7 | 9 | 9 |
| | ~80 | 2 | 3 | 3 | 4 | 6 | 7 | 9 | 9 |
| | ~90 | 2 | 3 | 4 | 5 | 6 | 8 | 10 | 10 |
| | ~100 | 3 | 3 | 4 | 5 | 6 | 8 | 10 | 10 |

FIG. 10

| ENVIRONMENTAL LEVEL | CORRECTION COEFFICIENT K_EV DETERMINED ACCORDING TO ENVIRONMENTAL LEVEL |
|---|---|
| 1 | 1.6 |
| 2 | 1.4 |
| 3 | 1.2 |
| 4 | 1.0 |
| 5 | 0.8 |
| 6 | 0.6 |
| 7 | 0.5 |
| 8 | 0.4 |
| 9 | 0.3 |
| 10 | 0.2 |

FIG. 11

| PROCESS SPEED [mm/second] | COEFFICIENT K_PS |
|---|---|
| 300 | 1.2 |
| 200 | 1.0 |
| 100 | 0.8 |

FIG. 12

| DEVELOPMENT BIAS (V) | COEFFICIENT K_DVB DETERMINED ACCORDING TO DEVELOPMENT BIAS |
|---|---|
| 0 ~ 150 | 0.4 |
| 151 ~ 250 | 0.6 |
| 251 ~ 350 | 0.8 |
| 351 ~ 450 | 1.1 |
| 451 ~ 550 | 1.3 |
| 551 ~ 600 | 1.5 |

FIG. 13

| CHARGING TIME OF PHOTOSENSITIVE DRUM (MINUTES) | COEFFICIENT K_US DETERMINED ACCORDING TO PREVIOUS HISTORY |
|---|---|
| 0 ~ 40 | 1.0 |
| 41 ~ 80 | 1.1 |
| 81 ~ 120 | 1.2 |
| 121 ~ 160 | 1.3 |
| 161 ~ 200 | 1.4 |
| 201 ~ 240 | 1.5 |

↑ START OF CHARGING CONTROL OF PHOTOSENSITIVE DRUM

IMAGE FORMING DEVICE, IMAGE DENSITY STABILIZATION CONTROL METHOD, AND RECORDING MEDIUM

BACKGROUND OF THE INVENTION

Field of the Invention

The present invention relates to an image forming device, an image density stabilization control method, and a recording medium. More specifically, the present invention relates to an electrographic image forming device, an image density stabilization control method of an electrographic image forming device, and a recording medium.

Description of the Background Art

When electrographic image forming devices are left under a low-humidity environment, the charged potential of a photosensitive drum can sometimes decrease immediately after the application of charge. Further, it is known that the electrostatic adhesion of a toner changes due to this phenomenon, which increases the likelihood of changes occurring in the image density.

In particular, when the electric potential of a photosensitive body changes immediately after the application of charge, a change occurs in the image density of the first and second pages. Such a phenomenon occurs most notably under a low-humidity environment.

In order to solve such a problem, conventionally disclosed is an invention relating to an image forming device which includes a control means that, by controlling an image exposure device based on conditions of the usage environment, a usage history, and a stop time, varies the amount of image exposure to the image exposure device for a section that was facing the charging device when the photosensitive drum was stopped such that a uniform bright area potential is ensured at the time of the next image formation, and which prevents image defects such as image distortions and unevenness in the image density from occurring by correcting decreases in the sensitivity of the surface of the photosensitive body caused by the charging device (for example, see Japanese Unexamined Patent Application Publication No. 2001-228657).

However, while the conventional technique of varying the light intensity of an image exposure device or the discharge light intensity of a discharge device based on conditions of the usage environment, a usage history, and a stop time enables a uniform bright area potential to be ensured for the second and subsequent image formations, a new technique was sought that prevents changes in the image density at the time of the first image formation, particularly with respect to those changes in the image density that occur immediately after the application of charge.

The present invention has been made in view of the above circumstances, and provides an image forming device that, relative to a conventional case, more effectively reduces changes in the image density caused by reductions in the charged potential immediately after the application of charge to a photosensitive body, an image density stabilization control method, and a computer-readable recording medium that records an image density stabilization control program.

SUMMARY OF THE INVENTION

The present invention provides an image forming device that forms an image by an electrographic method, including:

a photosensitive body; a charger that charges the photosensitive body at the time of printing; a charged potential fluctuation prediction unit that predicts an amount of fluctuation in a charged potential of the photosensitive body; an optical scanning device that irradiates the photosensitive body with an exposure laser and forms an electrostatic latent image; a development device that develops the electrostatic latent image; and an exposure laser output correction unit that corrects an output of the exposure laser; wherein the charged potential fluctuation prediction unit predicts, from a charging stop time, the amount of fluctuation in the charged potential after printing has been stopped, and the exposure laser output correction unit reduces a change in density of the image caused by a fluctuation in the charged potential by correcting the output of the exposure laser to be irradiated with respect to the photosensitive body according to the amount of fluctuation in the charged potential.

Furthermore, the present invention provides an image density stabilization control method of an image forming device that forms an image by an electrographic method, the image density stabilization control method including: charging a photosensitive body at the time of printing; predicting an amount of fluctuation in a charged potential of the photosensitive body; irradiating the photosensitive body with an exposure laser and forming an electrostatic latent image; developing the electrostatic latent image; and correcting an output of the exposure laser; wherein, in predicting the amount of fluctuation, the amount of fluctuation in the charged potential after printing has been stopped is predicted from a charging stop time, and, in correcting the output of the exposure laser, a change in density of the image caused by a fluctuation in the charged potential is reduced by correcting the output of the exposure laser to be irradiated with respect to the photosensitive body according to the amount of fluctuation in the charged potential.

In addition, the present invention provides a computer-readable recording medium that records an image density stabilization control program executed by an image forming device that forms an image by an electrographic method, the program causing a processor of the image forming device to execute: charging a photosensitive body at the time of printing; predicting an amount of fluctuation in a charged potential of the photosensitive body; irradiating the photosensitive body with an exposure laser and forming an electrostatic latent image; developing the electrostatic latent image; and correcting an output of the exposure laser; wherein, in predicting the amount of fluctuation, the amount of fluctuation in the charged potential after printing has been stopped is predicted from a charging stop time, and, in correcting the output of the exposure laser, a change in density of the image caused by a fluctuation in the charged potential is reduced by correcting the output of the exposure laser to be irradiated with respect to the photosensitive body according to the amount of fluctuation in the charged potential.

In the present invention, an "image forming device" refers to a device that forms and outputs an image, which includes copiers having a copy function, such as printers that use an electrographic method for image formation using a toner, and a multifunctional peripheral (MFP) which include functions other than copying.

According to the present invention, an image forming device that, relative to a conventional case, more effectively reduces changes in the image density caused by reductions in the charged potential immediately after the application of charge to a photosensitive body by means of detecting a charging stop time after printing is stopped and correcting an exposure laser output of the photosensitive body according to the charging stop time is realized. Further, an image density stabilization control method, and a computer-readable recording medium that records an image density stabilization control program are realized.

In addition, preferable aspects of the present invention will be described.

(2) The exposure laser output correction unit may determines a correction amount of the output of the exposure laser according to the charging stop time, and the optical scanning device may irradiate the photosensitive body with an exposure laser having an output in which the correction amount has been subtracted from the output of the exposure laser that would be irradiated with respect to the photosensitive body in the absence of a fluctuation in the charged potential.

In this manner, because the correction amount of the output of the exposure laser is determined according to the charging stop time, an image forming device can be realized that, relative to a conventional case, more effectively reduces changes in the image density caused by reductions in the charged potential immediately after the application of charge to a photosensitive body.

(3) The exposure laser output correction unit may determine the correction amount of the output of the exposure laser such that, when the charging stop time is shorter than a predetermined reference time, the correction amount of the output of the exposure laser increases as a charging duration of the charger becomes shorter.

In this manner, because the exposure laser output correction unit determines the correction amount of the output of the exposure laser such that the correction amount of the output of the exposure laser increases as the charging duration of the charger becomes shorter, an image forming device can be realized that, relative to a conventional case, more effectively reduces changes in the image density caused by reductions in the charged potential immediately after the application of charge to a photosensitive body.

(4) A temperature and humidity sensor may be further provided that detects a temperature and a humidity of the surroundings of the image forming device, and the exposure laser output correction unit may increase or decrease the correction amount of the output of the exposure laser according to the temperature and the humidity.

In this manner, because the exposure laser output correction unit increases and decreases the correction amount of the output of the exposure laser according to the temperature and the humidity of the surroundings of the image forming device, an image forming device can be realized that, relative to a conventional case, more effectively reduces changes in the image density caused by reductions in the charged potential immediately after the application of charge to a photosensitive body.

(5) The exposure laser output correction unit may increase the correction amount of the output of the exposure laser as the temperature and the humidity decrease.

In this manner, because the exposure laser output correction unit increases the correction amount of the output of the exposure laser when the temperature and the humidity of the surroundings of the image forming device decrease, an image forming device can be realized that, relative to a conventional case, more effectively reduces changes in the image density caused by reductions in the charged potential immediately after the application of charge to a photosensitive drum.

BRIEF DESCRIPTION OF THE DRAWINGS

FIG. 6 is an example of a basic correction table illustrating the relationship between a cumulative time from the start of charging a photosensitive drum and a correction amount.

FIGS. 7A and 7B are examples of a table that determines a correction start PHASE and a correction coefficient according to a stop time of a photosensitive drum.

FIG. 8 is an example of a correction coefficient table determined according to a life of a photosensitive drum.

FIG. 9 is an example of an environmental level table determined according to a temperature and a relative humidity of the surroundings of the digital multifunctional peripheral.

FIG. 10 is an example of a correction coefficient table determined according to the environmental level.

FIG. 11 is an example of a correction coefficient table determined according to a process speed of a photosensitive drum.

FIG. 12 is an example of a correction coefficient table determined according to a development bias of a photosensitive drum.

FIG. 13 is an example of a correction coefficient table determined according to a prior history of a photosensitive drum.

DESCRIPTION OF THE PREFERRED EMBODIMENTS

Hereinafter, the present invention is described in more detail using the drawings. The following description is in all respects illustrative, and is not to be construed as limiting the present invention.

First Embodiment

Figure 1:
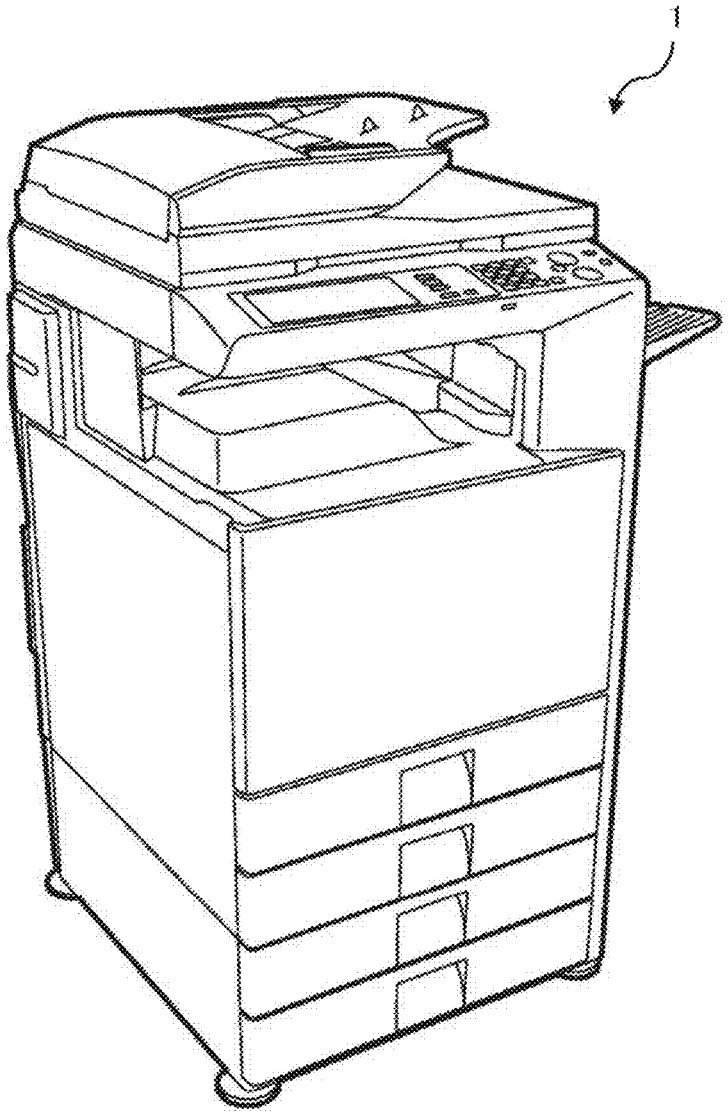
FIG. 1 is a perspective view illustrating the appearance of a digital multifunctional peripheral, which is an exemplary embodiment of an image forming device of the present invention.
Figure 2:
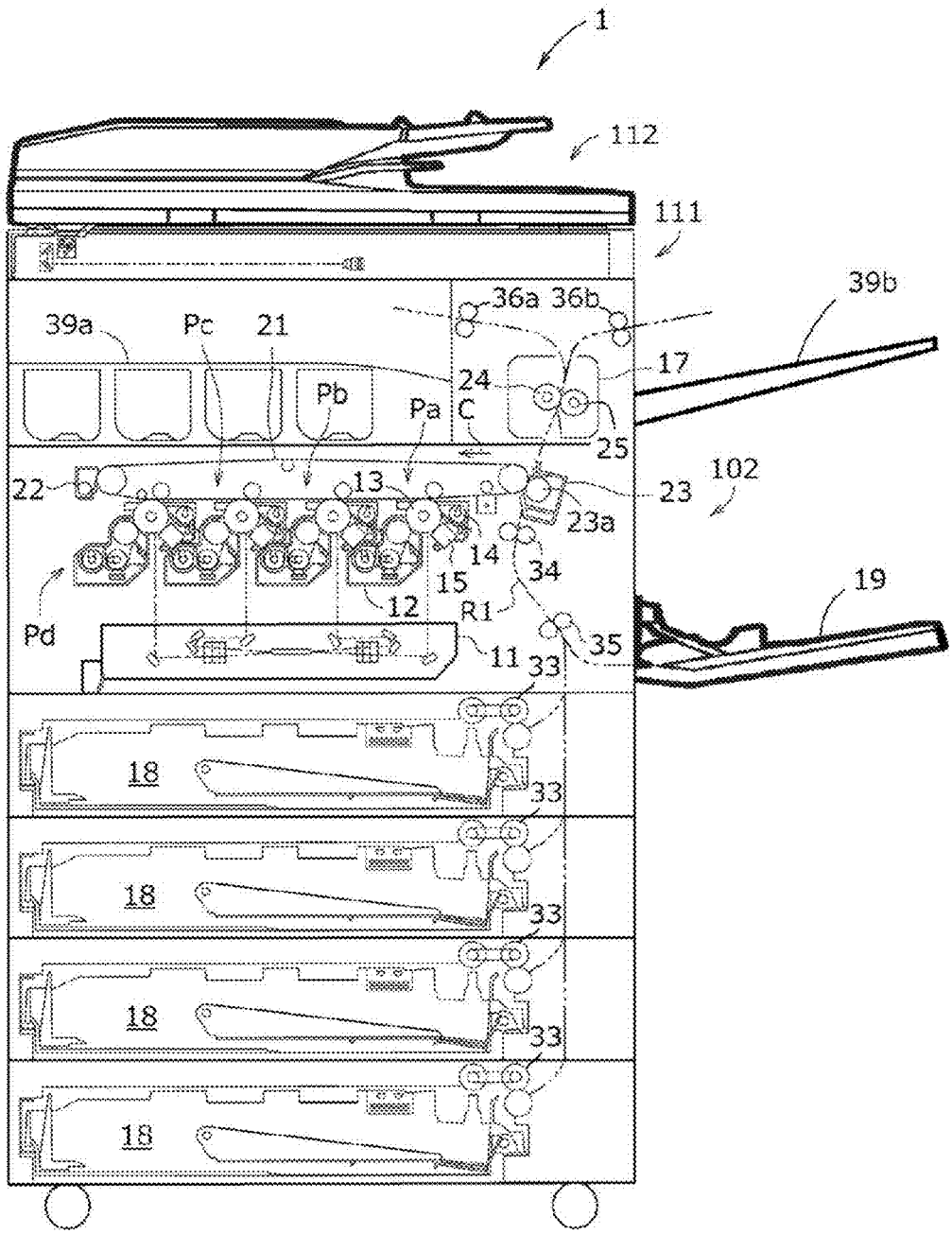
FIG. 2 is a cross-sectional view illustrating a mechanical configuration of a main body section of the digital multifunctional peripheral illustrated in FIG. 1.
Figure 3:
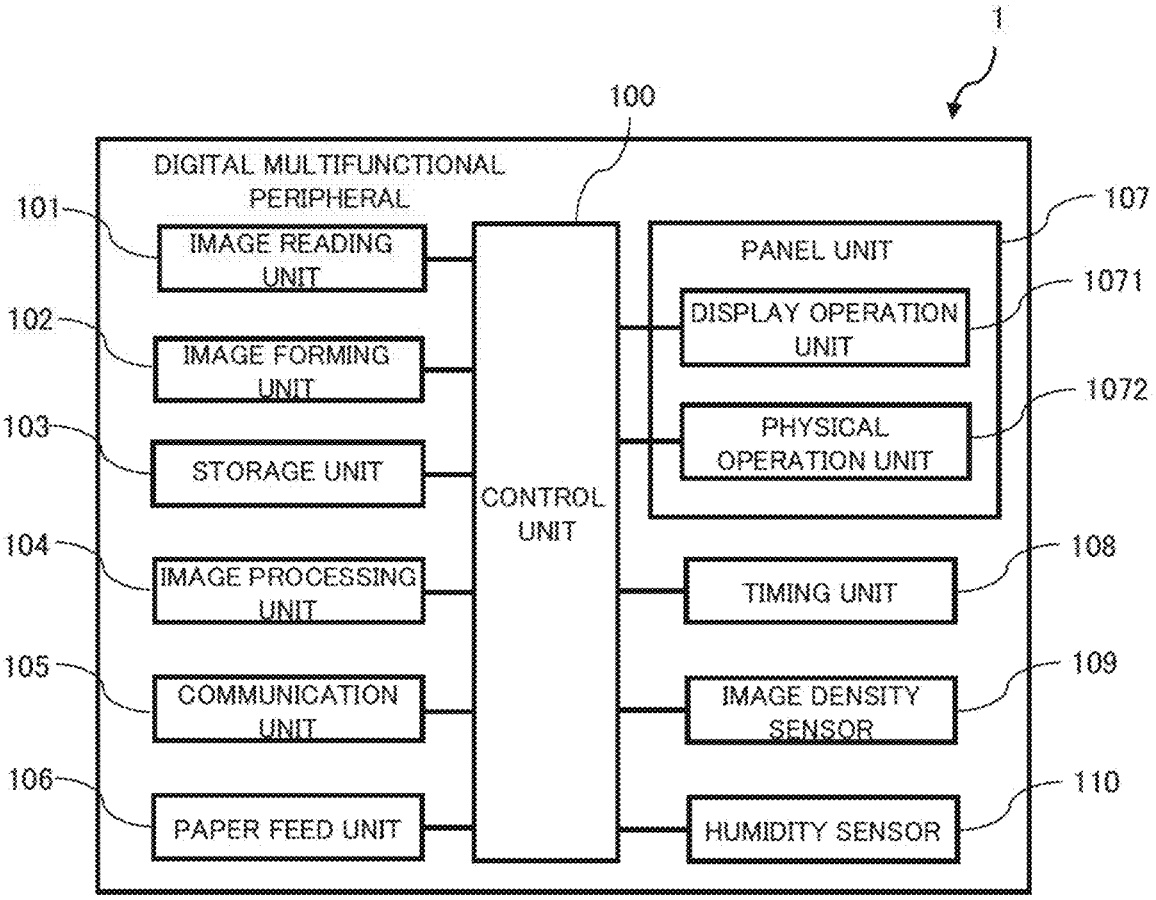
FIG. 3 is a block diagram illustrating a schematic configuration of the digital multifunctional peripheral illustrated in FIG. 1.

A digital multifunctional peripheral 1, which is an exemplary embodiment of an image forming device of the present invention, is described based on FIG. 1 to FIG. 3.

FIG. 1 is a perspective view illustrating the appearance of the digital multifunctional peripheral 1, which is an exemplary embodiment of an image forming device of the present invention. FIG. 2 is a cross-sectional view illustrating a mechanical configuration of a main body section of the digital multifunctional peripheral 1 illustrated in FIG. 1.

The digital multifunctional peripheral 1 performs digital processing of image data, and is a device such as a multifunctional peripheral (MFP) having a copy function, a scanner function, and a facsimile function.

As illustrated in FIG. 2, the digital multifunctional peripheral 1 has a document feed device 112 that feeds a document to a read unit, a document read device 111 that reads the document, and an image forming unit 102 that forms an image. The digital multifunctional peripheral 1 executes scanning, printing, and copying jobs based on a user instruction received via a display operation unit 1071, a physical operation unit 1072, or a communication unit 105 (see FIG. 3).

Configuration of Digital Multifunctional Peripheral 1

Here, an internal configuration of the digital multifunctional peripheral 1 illustrated in FIG. 2 is briefly described.

In the digital multifunctional peripheral 1, a color image using black (K), cyan (C), magenta (M), and yellow (Y) colors is printed on a print sheet. Alternatively, a monochrome image using a single color (such as black) is printed on a print sheet. Consequently, four development devices 12, four photosensitive drums 13, four drum cleaning devices 14, and four chargers 15 and the like are respectively provided. In order to form four types of toner images that correspond to each of the colors, four image stations Pa, Pb, Pc and Pd are configured where each station is associated with black, cyan, magenta, or yellow.

A toner image is formed as follows in each of the image stations Pa, Pb, Pc and Pd. The drum cleaning device 14 removes and collects residual toner from the surface of the photosensitive drum 13. Thereafter, the charger 15 uniformly charges the surface of the photosensitive drum 13 to a predetermined electric potential. Then, an optical scanning device 11 exposes the uniformly charged surface to form an electrostatic latent image on the surface. Thereafter, the development device 12 develops the electrostatic latent image. As a result, a toner image of each color is formed on the surface of each photosensitive drum 13.

Furthermore, an intermediate transfer belt 21 moves in a circulating manner in an arrow direction C. A belt cleaning device 22 removes and collects residual toner from the intermediate transfer belt 21, which moves in a circulating manner. A toner image of each color on the surface of each photosensitive drum 13 is successively transferred and superimposed on the intermediate transfer belt 21 to form a color toner image on the intermediate transfer belt 21.

A print sheet is pulled out from any one of four feeding trays 18 by a pickup roller 33, and is fed to a secondary transfer device 23 via a sheet transfer path R1. Alternatively, a print sheet is fed by a pickup roller (not shown) from a manual feed tray 19, and is fed to the secondary transfer device 23 via the sheet transfer path R1. A registration roller 34 is disposed in the sheet transfer path R1 to temporarily stop the print sheet and align the leading edge of the print sheet. Furthermore, a transfer roller 35 or the like is disposed which promotes transfer of the print sheet. After temporarily stopping the print sheet, the registration roller 34 transfers the print sheet to a nip area between the intermediate transfer belt 21 and a transfer roller 23*a* to coincide with the transfer timing of the toner image.

The nip area is formed between the transfer roller 23*a* of the secondary transfer device 23 and the intermediate transfer belt 21. When the print sheet passes through the nip, the color toner image formed on the surface of the intermediate transfer belt 21 is transferred onto the print sheet. After passing through the nip area, the print sheet is sandwiched between a heating roller 24 and a pressure roller 25 of a fixing device 17 and is heated and pressurized. The color toner image is fixed on the print sheet as a result of the heating and pressurization.

After passing through the fixing device 17, the print sheet is discharged to a discharge tray 39*a* or 39*b* via a discharge roller 36*a* or 36*b*. The discharge destination of the print sheet is controlled by a control unit 100 described below, and the transfer path is switched by a switching mechanism (not shown) such that the print sheet is guided to either one of the discharge trays 39*a* or 39*b*. Detailed illustration of the switching mechanism of the print sheet transfer path is omitted because it is well known in the technical field of image forming devices.

Next, a schematic configuration of the digital multifunctional peripheral 1 is described based on FIG. 3.

FIG. 3 is a block diagram illustrating a schematic configuration of the digital multifunctional peripheral 1 illustrated in FIG. 1.

As illustrated in FIG. 3, the digital multifunctional peripheral 1 includes a control unit 100, an image reading unit 101, an image forming unit 102, a storage unit 103, an image processing unit 104, a communication unit 105, a paper feed unit 106, a panel unit 107, a timing unit 108, an image density sensor 109, and a temperature and humidity sensor 110.

The constituent elements of the digital multifunctional peripheral 1 are described below.

The control unit 100 integrally controls the digital multifunctional peripheral 1, and includes a central processing unit (CPU), a random access memory (RAM), a read only memory (ROM), various interface circuits, and the like.

In order to control the overall operation of the digital multifunctional peripheral 1, the control unit 100 monitors and controls detection by each sensor, the motor, the clutch, the panel unit 107 and the like, and various types of loads.

Furthermore, the control unit 100 may read and execute an image density stabilization control program recorded on a computer-readable recording medium.

The image reading unit 101 is a section that detects and reads a document such as a card placed on a document placement table, or a document transferred from a document tray, and generates image data.

The image forming unit 102 is a section that prints and outputs image data generated by the image processing unit 104 onto a sheet of paper.

The storage unit 103 is an element or a storage medium that stores information and a control program required for realizing the various functions of the digital multifunctional peripheral 1. For example, a semiconductor element such as a RAM or a ROM, or a storage medium such as a hard disk, a flash storage unit, or a solid state drive (SSD), is used.

The program and data may be held in different devices, such as a configuration where the area holding the data is on a hard disk drive, and the area holding the program is on a flash storage unit.

The image processing unit 104 is a section that converts a document image read by the image reading unit 101 into an appropriate electrical signal, and generates image data. Furthermore, the image processing unit 104 is a section that performs processing according to an instruction from a display operation unit 1071 such that the image data input from the image reading unit 101 is made suitable for output in an enlarged/reduced form and the like. Moreover, the image processing unit 104 is a section that associates a plurality of image data according to a predetermined layout.

The communication unit 105 is a section that communicates with devices such as computers, portable information terminals, external information processing devices, and facsimile devices via a network and the like, and transmits and receives various information such as mail and faxes with respect to these external communication devices.

The paper feed unit 106 is a section that transfers a piece of paper stored in a paper feeding cassette or a manual feed tray to the image forming unit 102.

The panel unit 107 is a unit provided with a liquid crystal display, and includes the display operation unit 1071 and a physical operation unit 1072.

The display operation unit 1071 displays various information, and is a section that receives user instructions by a touch panel function. The display operation unit 1071 is configured by a cathode ray tube (CRT) display, a liquid crystal display, an electronic luminescent (EL) display, or the like, and is a display device such as a monitor or line display for displaying electronic data such as the processing state of the operating system or application software. The control unit 100 displays the operation and state of the digital multifunctional peripheral 1 via the display operation unit 1071.

The timing unit 108 is a section that measures time, and acquires the time via an internal clock or a network for example. The control unit 100 refers to the time acquired by the timing unit 108 and detects a stop time and the like of the photosensitive drum 13.

The image density sensor 109 is a sensor that detects an image density from the density of the electrostatic latent image formed on the photosensitive drum 13.

The temperature and humidity sensor 110 is a sensor that detects the temperature and the humidity of the surroundings of the digital multifunctional peripheral 1.

The "photosensitive body" of the present invention is realized by the photosensitive drum 13. Furthermore, the "charged potential fluctuation prediction unit" of the present invention is realized by cooperative operation of the control unit 100 and the timing unit 108. Moreover, the "development unit" of the present invention is realized by the development device 12. In addition, the "exposure laser output correction unit" of the present invention is realized by cooperative operation of the optical scanning device 11 and the control unit 100.

Image Density Stabilization Control of Digital Multifunctional Peripheral 1

Next, image density stabilization control of the digital multifunctional peripheral 1 according to the first embodiment of the present invention is described with reference to FIGS. 4A and 4B to FIG. 14.

Figure 4A:
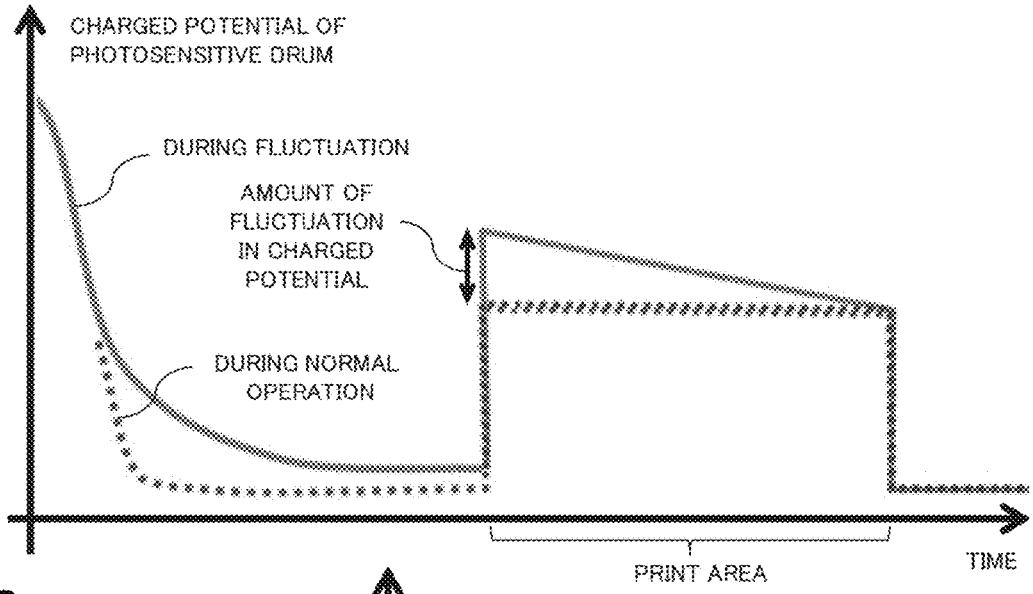
FIGS. 4A and 4B are explanatory views illustrating an outline of image density stabilization control of the digital multifunctional peripheral illustrated in FIG. 1.
Figure 4B:
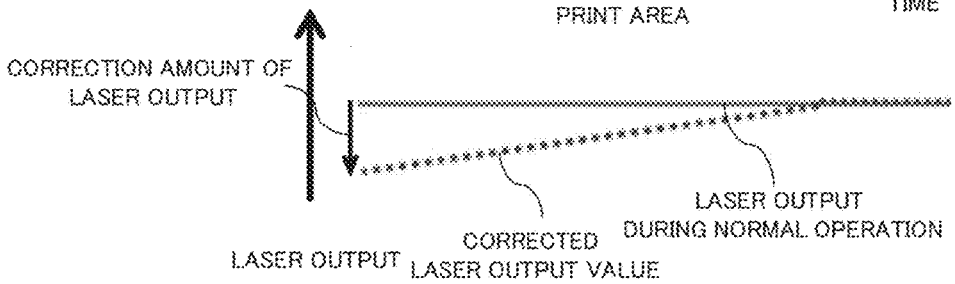
Figure 5:
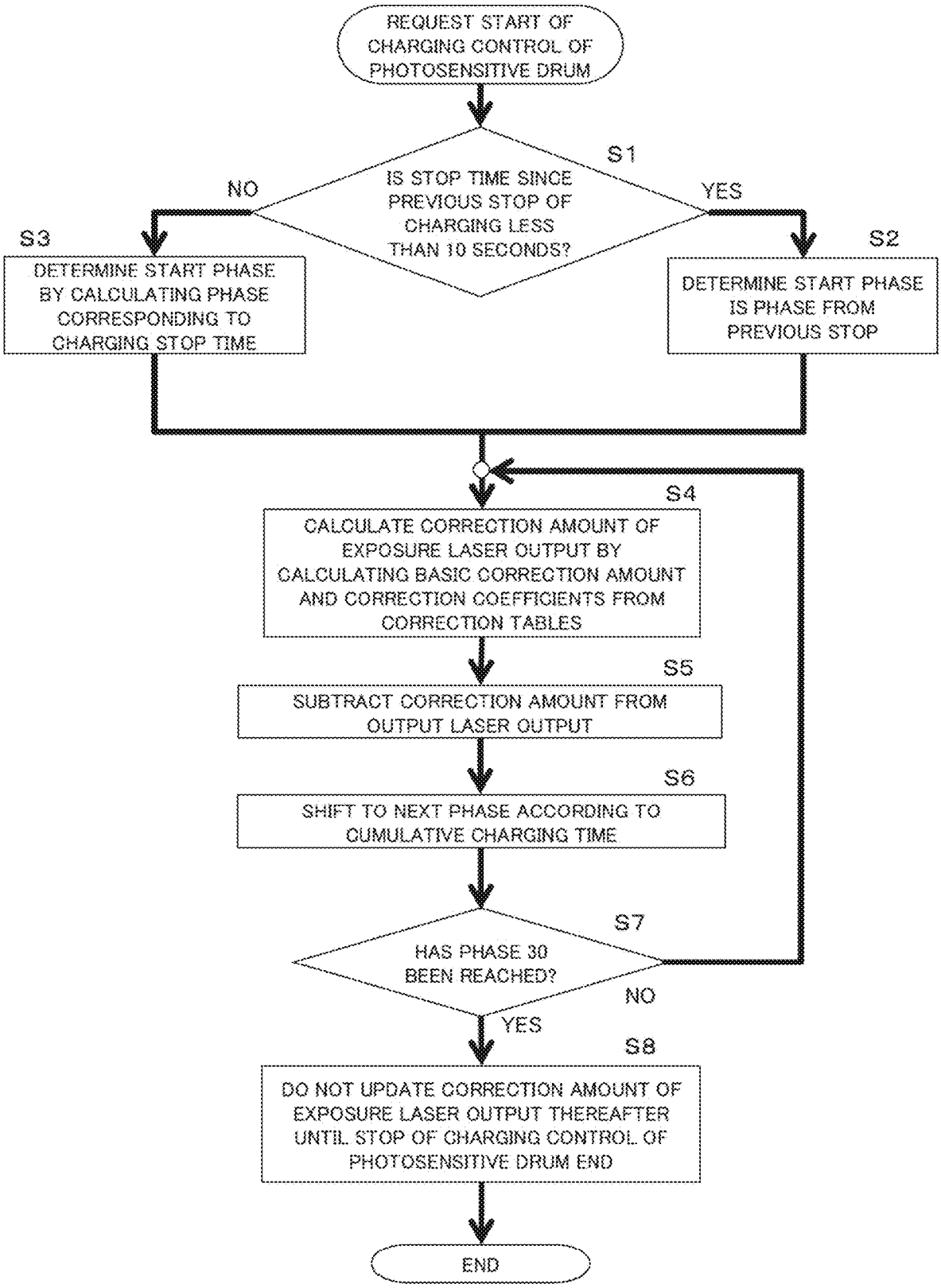
FIG. 5 is a flowchart illustrating the processing for image density stabilization control of the digital multifunctional peripheral illustrated in FIG. 1.
Figure 14:
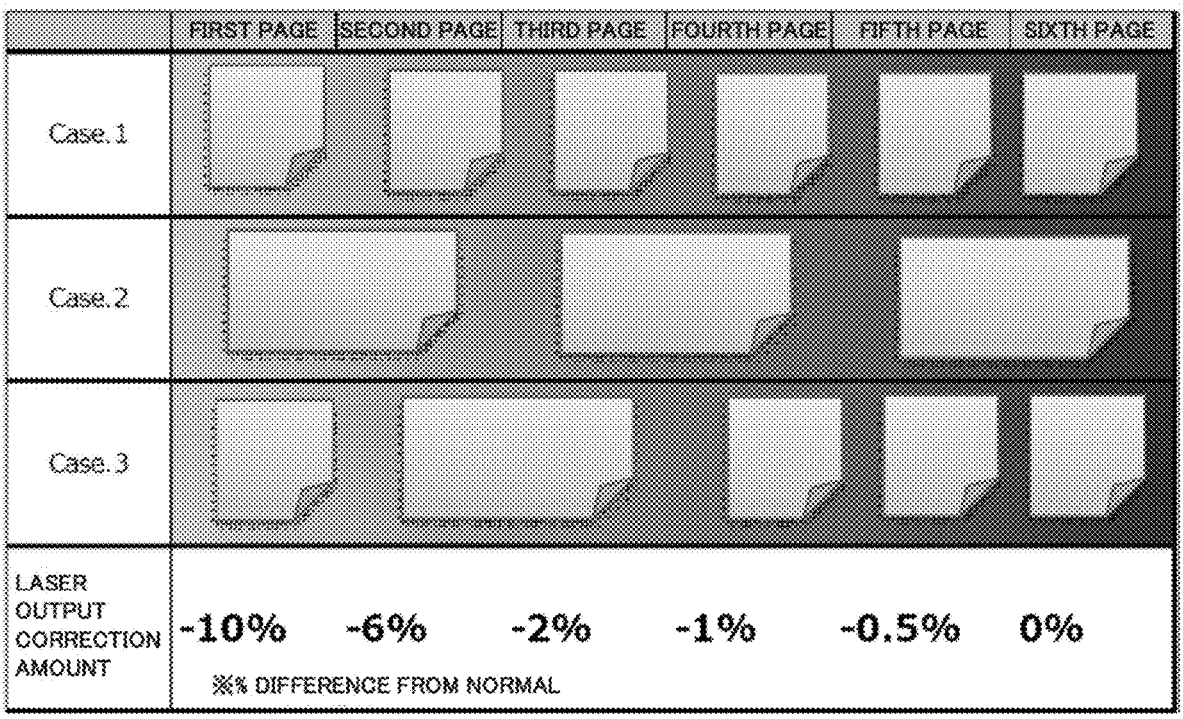
FIG. 14 is an explanatory view illustrating an example of correction of an exposure laser output of a photosensitive drum.

FIGS. 4A and 4B are explanatory views illustrating an outline of image density stabilization control of the digital multifunctional peripheral 1 illustrated in FIG. 1. FIG. 5 is a flowchart illustrating the processing for image density stabilization control of the digital multifunctional peripheral 1 illustrated in FIG. 1. FIG. 6 is an example of a basic correction table illustrating the relationship between a cumulative time from the start of charging the photosensitive drum 13 and a correction amount. FIGS. 7A and 7B are examples of a table that determines a correction start PHASE and a correction coefficient according to a stop time of the photosensitive drum 13. FIG. 8 is an example of a correction coefficient table determined according to a life of the photosensitive drum 13. FIG. 9 is an example of an environmental level table determined according to a temperature and a relative humidity of the surroundings of the digital multifunctional peripheral 1. FIG. 10 is an example of a correction coefficient table determined according to the environmental level. FIG. 11 is an example of a correction coefficient table determined according to a process speed of the photosensitive drum 13. FIG. 12 is an example of a correction coefficient table determined according to a development bias of the photosensitive drum 13. FIG. 13 is an example of a correction coefficient table determined according to a prior history of the photosensitive drum 13. FIG. 14 is an explanatory view illustrating an example of correction of an exposure laser output of the photosensitive drum 13.

FIGS. 4A and 4B illustrate outlines of image density stabilization control of the digital multifunctional peripheral 1 according to the first embodiment of the present invention.

In FIG. 4A, the horizontal axis represents time, and the vertical axis represents the charged potential (arbitrary units) of the photosensitive drum 13.

Furthermore, the dotted line graph in FIG. 4A represents the charged potential during normal operation, and the solid line graph represents the charged potential when fluctuation occurs.

As illustrated in FIG. 4A, when a change in the charged potential of the photosensitive drum 13 occurs, the charged potential changes from the dotted line graph to the solid line graph. Further, as a result of such a fluctuation in the charged potential, a change in the image density of the printed area occurs.

Fluctuations in the charged potential appear most notably immediately after the application of charge, and gradually decrease thereafter.

Therefore, as illustrated in FIG. 4B, by correcting the exposure laser output value of the photosensitive drum 13 according to the amount of fluctuation in the charged potential, changes in the image density of the printed area caused by fluctuations in the charged potential are reduced.

FIG. 5 illustrates an example of processing for image density stabilization control of the digital multifunctional peripheral 1 according to the first embodiment of the present invention.

In FIG. 5, when the control unit 100 receives a request to start charging control of the photosensitive drum 13, it determines in step S1 whether or not a stop time of the photosensitive drum 13 since charging was stopped the previous time is less than 10 seconds (step S1).

Specifically, the control unit 100 causes the timing unit 108 to measure an end time Tend when charging control of the photosensitive drum 13 was stopped the previous time, and stores the end time Tend in the storage unit 103.

Thereafter, the control unit 100 causes the timing unit 108 to measure a present time Tpre when charging control of the photosensitive drum 13 is restarted, and calculates the stop time of the photosensitive drum 13 from the difference between the present time Tpre and the end time Tend stored in the storage unit 103.

The control unit 100 causes the timing unit 108 to measure stop times corresponding to the photosensitive drum 13 of each image station Pa, Pb, Pc, and Pd, and stores the stop times in the storage unit 103.

If the stop time since charging was stopped the previous time is less than 10 seconds (if the determination in step S1 is Yes), the control unit 100 determines in step S2 that the start PHASE is the PHASE from the previous stop (step S2).

Specifically, the control unit 100 refers to the basic correction table in FIG. 6, and determines the PHASE according to a cumulative charging time (milliseconds) since the start of charging the photosensitive drum 13.

In the basic correction table in FIG. 6, for example, the PHASE is determined as "PHASE 1" if the cumulative charging time from the start of charging the photosensitive drum 13 is at least 0 milliseconds but less than 80 milliseconds, "PHASE 2" if the cumulative charging time is at least 80 milliseconds but less than 160 milliseconds, and so on.

Numerical ranges in the table in FIG. 6 that are expressed in the form "X to Y", are assumed to denote "at least X but less than Y". The same applies to FIGS. 8, 9, 12, and 13.

Thereafter, for example, if less than 10 seconds have elapsed since charging was stopped in "PHASE 10", the control unit 100 starts from "PHASE 10", which was the PHASE at the time of the previous stop.

On the other hand, in step S1 of FIG. 5, if the charging stop time since charging was stopped the previous time is 10 seconds or more (if the determination in step S1 is No), the control unit 100 in step S3 calculates the PHASE corresponding to the charging stop time of the photosensitive drum 13 (step S3).

Specifically, the control unit 100 calculates the PHASE from the equation in FIG. 7A.

In FIG. 7A, the symbol [x] on the right side of the equation is assumed to represent the integer part of x.

For example, when the charging stop time is 100 seconds, the PHASE from the equation in FIG. 7A becomes 3, and therefore, the control unit 100 starts from PHASE 3.

The equation in FIG. 7A is, as illustrated in the table in FIG. 7B, applied to cases where the charging stop time is at least 10 seconds but less than 120 seconds.

On the other hand, when the charging stop time is 120 seconds or more, as illustrated in the table in FIG. 7B, the control unit 100 starts from PHASE 1.

For example, when the charging stop time is 30 hours, the PHASE becomes 1 from the table in FIG. 7B, and therefore, the control unit 100 starts from PHASE 1.

Next, in FIG. 5, after completing the processing of step S2 or S3, the control unit 100 in step S4 calculates a basic correction amount Re_mul and correction coefficients kl_x, k_ev, k_ps, k_dvb, k_us, and k_ti from correction tables to calculate a correction amount LDP_revise of the exposure laser output (step S4).

Specifically, the control unit 100 calculates the correction amount LDP_revise of the exposure laser output based on the formula below.

$$LDP_revise = Re_mul \times k_ti \times kl_x \times k_ev \times k_ps \times k_dvb \times k_us$$

Here, the basic correction amount Re_mul and the correction coefficients kl_x, k_ev, k_ps, k_dvb, k_us, and k_ti are each defined as follows.

(1) Re_mul: basic correction amount of exposure laser output (2) k_ti: correction coefficient determined according to charging stop time (3) kl_x: correction coefficient determined according to film thickness loss correction count of photosensitive drum 13 of each color (4) k_ev: correction coefficient determined according to environmental level (5) k_ps: correction coefficient determined according to process speed (6) k_dvb: correction coefficient determined according to development bias value (7) k_us: correction coefficient determined according to prior history Hereinafter, the basic correction amount and the correction coefficients of the exposure laser output are described in detail.

(1) Basic Correction Amount Re_Mul of Exposure Laser Output

The control unit 100 refers to the basic correction table in FIG. 6 and calculates the basic correction amount Re_mul of the exposure laser output for each PHASE.

Furthermore, the basic correction amount Re_mul of the exposure laser output also differs depending on the process speed (linear speed) (mm/second) of the photosensitive drum 13.

For example, from the table in FIG. 6, the basic correction amount Re_mul in PHASE 10 becomes 2, 5, and 7 at 100 (mm/second), 200 (mm/second), and 300 (mm/second), respectively.

(2) Correction Coefficient k_ti Determined According to Charging Stop Time

The control unit 100 refers to the table in FIG. 7B and calculates a correction coefficient k_ti according to the charging stop time of the photosensitive drum 13.

For example, as illustrated in the table in FIG. 7B, when the charging stop time is at least 10 seconds but less than 120 seconds, the correction coefficient k_ti is calculated to be 1.0. When the charging stop time is at least 120 seconds but less than 600 seconds, the correction coefficient k_ti is calculated to be 1.1. Furthermore, when the charging stop time is at least 1 hour but less than 2 hours, the correction coefficient k_ti is calculated to be 1.3, and so on.

(3) Correction Coefficient kl_x Determined According to Film Thickness Loss Correction Count of Photosensitive Drum 13 of Each Color The control unit 100 refers to the table in FIG. 8 and calculates a correction coefficient kl_x according to the film thickness loss correction count of the photosensitive drum 13.

Specifically, as illustrated in the table in FIG. 8, when the charging control time proportion (proportion with respect to the lifetime charging control time) of the photosensitive drum 13 is at least 0% but less than 5%, the correction coefficient kl_x is calculated to be 1.0. When the charging control time proportion is at least 5% but less than 10%, the correction coefficient kl_x is calculated to be 1.1. Furthermore, when the charging control time proportion is at least 20% but less than 25%, the correction coefficient kl_x is calculated to be 1.5, and so on.

Moreover, the control unit 100 calculates a correction coefficient kl_x (where x corresponds to each of x=K, C, M, and Y) corresponding the photosensitive drum 13 of each image station Pa, Pb, Pc, and Pd.

(4) Correction Coefficient k_ev Determined According to Environmental Level

The control unit 100 causes the temperature and humidity sensor 110 to detect the environmental temperature and humidity of the surroundings of the digital multifunctional peripheral 1 at the start of charging control of the photosensitive drum 13, and refers to the environmental level table of FIG. 9 in calculate an environmental level value.

Specifically, as illustrated in the table in FIG. 9, the control unit 100 determines the environmental level value from the entry where the relative humidity (%) and the temperature (° C.) intersect.

For example, when the relative humidity is at least 40% but less than 50%, and the temperature is at least 20° C. but less than 25° C., the environmental level value becomes 4.

In the table in FIG. 9, the environmental level value approaches 1 under low-humidity and low-temperature environments, and the environmental level value approaches 10 under high-humidity and high-temperature environments.

The control unit 100 refers to the environmental level value calculated from the table in FIG. 9, and refers to the correction coefficient table in FIG. 10 to calculate a correction coefficient k_ev according to the environmental level.

For example, when the environmental level value is 4, the correction coefficient k_ev becomes 1.0.

(5) Correction Coefficient k_ps Determined According to Process Speed

The control unit 100 refers to the correction coefficient table in FIG. 11 and calculates a correction coefficient k_ps according to the process speed of the photosensitive drum 13.

As illustrated in the table in FIG. 11, correction coefficients k_ps are determined for process speeds (mm/second) of 100, 200, and 300.

For example, when the process speed is 200 mm/second, the correction coefficient k_ps becomes 1.0.

(6) Correction Coefficient k_dvb Determined According to Development Bias Value

The control unit 100 refers to the correction coefficient table in FIG. 12 and calculates a correction coefficient k_dvb according to the development bias of the photosensitive drum 13.

As illustrated in the table in FIG. 12, a correction coefficient k_dvb is determined according to the development bias value (V) of the process control result.

For example, when the development bias value is at least 251 but less than 350, the correction coefficient k_dvb becomes 0.8.

(7) Correction Coefficient k_us Determined According to Prior History

The control unit 100 refers to the correction coefficient table in FIG. 13 and calculates a correction coefficient k_us according to the prior history of the photosensitive drum 13.

In the example of FIG. 13, the "charging time of the photosensitive drum 13 in the immediately preceding 48 hours" is set as the prior history of the photosensitive drum 13, and the correction coefficient k_us is determined according to the cumulative time thereof.

As illustrated in the table in FIG. 13, the correction coefficient k_us is determined according to the charging time (minutes) of the photosensitive drum 13 in the immediately preceding 48 hours.

For example, when the charging time of the photosensitive drum 13 is at least 81 minutes but less than 120 minutes, the correction coefficient k_us becomes 1.2.

When the stop time detected at the start of charging control of the photosensitive drum 13 is 48 hours or more, the control unit 100 sets the correction coefficient k_us to 1.0 irrespective of the charging time.

Furthermore, the control unit 100 causes the timing unit 108 to measure the charging time of the photosensitive drum 13 of each image station Pa, Pb, Pc, and Pd, and stores the charging times in the storage unit 103.

Furthermore, when a drum unit counter is reset, the control unit 100 clears the prior history.

In this manner, the control unit 100 calculates the correction amount LDP_revise of the exposure laser output from the basic correction amount Re_mul and the correction coefficients kl_x, k_ev, k_ps, k_dvb, k_us, and k_ti.

Next, in step S5 of FIG. 5, the control unit 100 subtracts the correction amount calculated in step S4 from the exposure laser output (step S5).

Then, in step S6, the control unit 100 shifts to the next PHASE according to the cumulative charging time of the photosensitive drum 13 (step S6).

Specifically, the control unit 100 refers to the table in FIG. 6, and appropriately shifts to the PHASE corresponding to the cumulative charging time of the photosensitive drum 13.

Next, in step S7, the control unit 100 determines whether or not PHASE 30 has been reached (step S7).

If PHASE 30 has been reached (if the determination in step S7 is Yes), the control unit 100 in step S8 subsequently does not update the correction amount of the exposure laser output until charging control of the photosensitive drum 13 is stopped (step S8).

Thereafter, the control unit 100 ends charging control of the photosensitive drum 13 at the end of printing.

On the other hand, if PHASE 30 has not been reached (if the determination in step S7 is No), the control unit 100 returns the processing to step S4 (step S4).

As a result, as illustrated in FIG. 14, the correction amount of the exposure laser output is corrected stepwise based on the most recent charge usage frequency, facility environment, and charging stop time of the photosensitive drum 13, and according to the charging duration since the start of charging control of the photosensitive drum 13.

In the example of FIG. 14, the correction amount of the exposure laser output is corrected stepwise to −10% for the first page, −6% for the second page, −2% for the third page, −1% for the fourth page, −0.5% for the fifth page, and 0% for the sixth page.

In this manner, as a result of detecting the charging stop time of the photosensitive drum 13 and the facility environment of the digital multifunctional peripheral 1 and the like, and performing appropriate corrections to the exposure laser output of the photosensitive drum 13, a digital multifunctional peripheral 1 is realized that, relative to a conventional case, more effectively reduces changes in the image density caused by reductions in the charged potential immediately after the application of charge to the photosensitive drum 13.

Second Embodiment

Next, an example of image density stabilization control in a digital multifunctional peripheral 1 according to a second embodiment is described with reference to FIG. 15.

Figure 15:
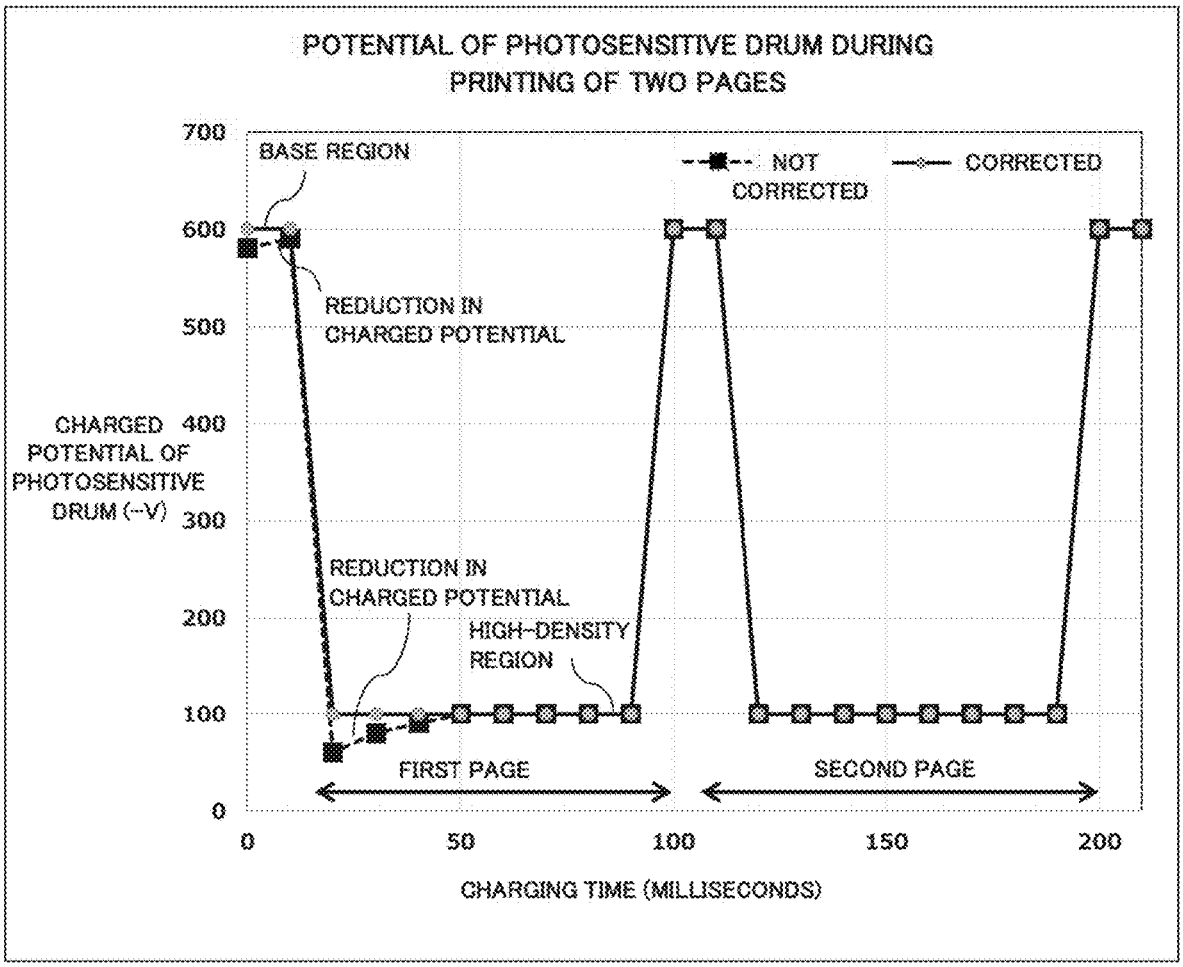
FIG. 15 is a graph illustrating the change in the charged potential of a photosensitive drum when two sheets of paper are printed in a digital multifunctional peripheral according to a second embodiment, and a correction example thereof.

FIG. 15 is a graph illustrating the change in the charged potential of the photosensitive drum 13 when two sheets of paper are printed in the digital multifunctional peripheral 1 according to the second embodiment, and a correction example thereof.

When two sheets of paper are printed, the change in the charged potential of the photosensitive drum 13 takes the form of the graph in FIG. 15.

For simplicity, it is assumed that printing of the first sheet of paper is performed up to 100 milliseconds, and printing of the second sheet of paper is performed up to 200 milliseconds.

In the graph of FIG. 15, the horizontal axis represents the charging time (milliseconds) and the vertical axis represents the charged potential (−V) of the photosensitive drum 13. The density increases as the charged potential approaches 0 V.

Furthermore, the dashed line graph represents the change in the charged potential before correction, and the solid line graph represents the charged potential after correction.

As indicated by the dashed line graph in FIG. 15, before correction, a reduction in the charged potential is observed immediately after printing the first sheet of paper.

Therefore, in the second embodiment, as indicated by the solid line graph in FIG. 15, correction is performed such that the base region at −600 V and the high-density region at −100 V become constant charged potentials.

Furthermore, the control unit 100 similarly performs correction with respect to not only the high-density region, but also other density regions.

In this manner, when a plurality of sheets are printed, by appropriately correcting the exposure laser output according to the number of printed sheets, a digital multifunctional peripheral 1 is realized that, relative to a conventional case, more effectively reduces changes in the image density caused by reductions in the charged potential immediately after the application of charge to the photosensitive drum 13.

Third Embodiment

Next, an example of image density stabilization control in a digital multifunctional peripheral 1 according to a third embodiment is described with reference to FIG. 16.

Figure 16:
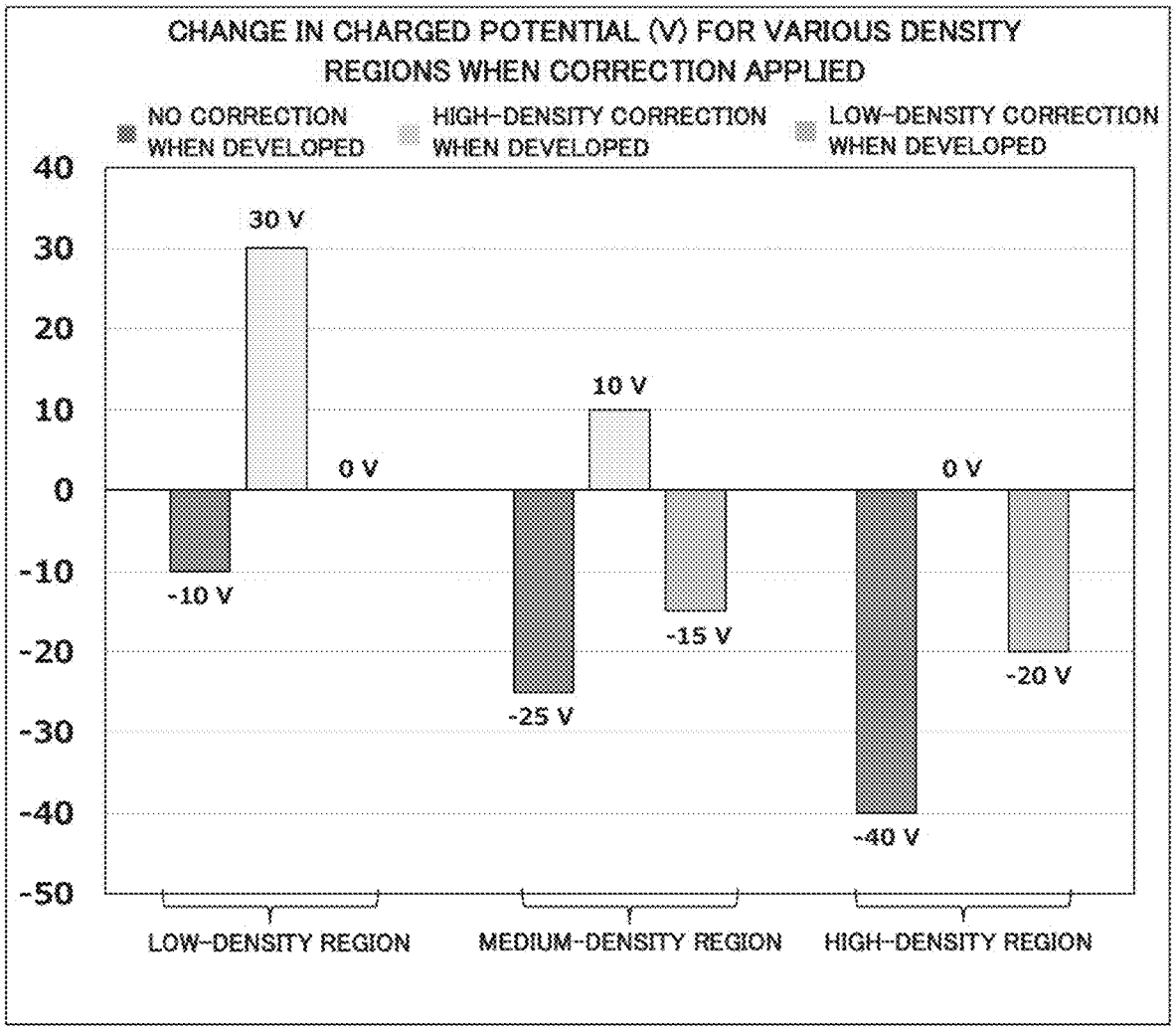
FIG. 16 is a graph illustrating an example of the changes in the charged potential in various density regions for a photosensitive drum in a digital multifunctional peripheral according to a third embodiment.

FIG. 16 is a graph illustrating an example of the change in the charged potential of in various density regions for the photosensitive drum 13 in a digital multifunctional peripheral 1 according to the third embodiment.

The change in the charged potential of the photosensitive drum 13 without correction and when correction is applied takes the form of the graph of FIG. 16.

In the graph of FIG. 16, the horizontal axis represents the change in the charged potential of the photosensitive drum 13 in a low-density region, a medium-density region, and a high-density region, and the vertical axis represents the charged potential (V) of the photosensitive drum 13.

Furthermore, in order from the left within each density region is shown the change in the charged potential when correction is not applied, when a high-density correction is applied, and when a low-density correction is applied.

The table below presents the change in the charged potential in each density region.

TABLE 1

| | Application state of correction | | |
|---|---|---|---|
| | Low-density region | Medium-density region | High-density region |
| correction | −10 V | −25 V | −40 V |
| Medium-density correction applied | 30 V | 10 V | 0 V |
| High-density correction applied | 0 V | −15 V | −20 V |

In addition, the effect of a correction with respect to a low-density region and a high-density region differs depending on the correction amount.

For example, application of a low-density correction results in matching of the density in the low-density region. Further, even though the high-density state improves in the high-density region, the effect is insufficient.

On the other hand, application of a high-density correction results in matching of the density at a high density. However, the density conversely becomes low in the low-density region.

Therefore, the control unit 100 performs the appropriate correction according to the image density detected by the image density sensor 109.

The example of FIG. 16 described three types of density regions, namely a low-density region, a medium-density region, and a high-density region, and two cases of density correction application, namely application of a high-density correction and application of a low-density correction. However, corrections may be performed that support more diversity in the types of density regions and density corrections.

In this manner, by appropriately correcting the exposure laser output according to differences in density of the low-density region, the medium-density region, and the high-density region, a digital multifunctional peripheral 1 is realized that, relative to a conventional case, more effectively reduces changes in the image density caused by reductions in the charged potential immediately after the application of charge to the photosensitive drum 13.

Preferred embodiments of the present invention also include combinations of any of the plurality of embodiments described above.

Various modifications may be made to the present invention in addition to the embodiments described above. Those modifications are not to be construed as falling outside the scope of the present invention. The scope of the present invention should include all modifications within the scope of the claims and all the equivalents thereof.

What is claimed is:

1. An image forming device that forms an image by an electrographic method, comprising:

a photosensitive body;

a charger that charges the photosensitive body at the time of printing;

a charged potential fluctuation prediction unit that predicts an amount of fluctuation in a charged potential of the photosensitive body;

an optical scanning device that irradiates the photosensitive body with an exposure laser and forms an electrostatic latent image;

a development device that develops the electrostatic latent image; and an exposure laser output correction unit that corrects an output of the exposure laser; wherein the charged potential fluctuation prediction unit predicts the amount of fluctuation in the charged potential after printing from a combination of a charging stop time and a charging duration of the charger, the exposure laser output correction unit reduces a change in density of the image caused by a fluctuation in the charged potential by correcting the output of the exposure laser to be irradiated with respect to the photosensitive body according to the amount of fluctuation in the charged potential, the exposure laser output correction unit determines the correction amount of the output of the exposure laser such that, when the charging stop time is shorter than a predetermined reference time, the correction amount of the output of the exposure laser increases as a charging duration of the charger becomes shorter, and the exposure laser output correction unit determines the correction amount of the output of the exposure laser according to a length of the charging stop time, when the charging stop time is the same as or longer than the predetermined reference time.

2. The image forming device according to claim 1, wherein the exposure laser output correction unit determines a correction amount of the output of the exposure laser according to the charging stop time, and the optical scanning device irradiates the photosensitive body with an exposure laser having an output in which the correction amount has been subtracted from the output of the exposure laser that would be irradiated with respect to the photosensitive body in the absence of a fluctuation in the charged potential.

3. The image forming device according to claim 1, further comprising:

a temperature and humidity sensor that detects a temperature and a humidity of the surroundings of the image forming device; wherein the exposure laser output correction unit increases or decreases the correction amount of the output of the exposure laser according to the temperature and the humidity.

4. The image forming device according to claim 3, wherein the exposure laser output correction unit increases the correction amount of the output of the exposure laser as the temperature and the humidity decrease.

5. The image forming device according to claim 1, wherein when the image is formed on a plurality of sheets of paper, the exposure laser output correction unit determines the correction amount of the output of the exposure laser according to the number of the sheets of paper.

6. The image forming device according to claim 1, further comprising an image density sensor that detects an image density from the density of the electrostatic latent image formed on the photosensitive body, wherein the exposure laser output correction unit determines the correction amount of the output of the exposure laser according to differences in the density.

7. An image density stabilization control method of an image forming device that forms an image by an electrographic method, the image density stabilization control method comprising:

charging a photosensitive body at the time of printing;

predicting an amount of fluctuation in a charged potential of the photosensitive body;

irradiating the photosensitive body with an exposure laser and forming an electrostatic latent image;

developing the electrostatic latent image; and correcting an output of the exposure laser; wherein in predicting the amount of fluctuation, the amount of fluctuation in the charged potential after printing has been stopped is predicted from a combination of a charging stop time and a charging duration in charging the photosensitive body, in correcting the output of the exposure laser, a change in density of the image caused by a fluctuation in the charged potential is reduced by correcting the output of the exposure laser to be irradiated with respect to the photosensitive body according to the amount of fluctuation in the charged potential, in correcting the output of the exposure laser, a correction amount of the output of the exposure laser is determined such that, when the charging stop time is shorter than a predetermined reference time, the correction amount of the output of the exposure laser increases as the charging duration in charging the photosensitive body becomes shorter, and in correcting the output of the exposure laser, the correction amount of the output of the exposure laser is determined according to a length of the charging stop time, when the charging stop time is the same as or longer than the predetermined reference time.

8. A computer-readable non-transitory recording medium that records an image density stabilization control program executed by an image forming device that forms an image by an electrographic method, the program causing a processor of the image forming device to execute:

charging a photosensitive body at the time of printing;

predicting an amount of fluctuation in a charged potential of the photosensitive body;

irradiating the photosensitive body with an exposure laser and forming an electrostatic latent image;

developing the electrostatic latent image; and correcting an output of the exposure laser; wherein in predicting the amount of fluctuation, the amount of fluctuation in the charged potential after printing has been stopped is predicted from a combination of a charging stop time and a charging duration in charging the photosensitive body, in correcting the output of the exposure laser, a change in density of the image caused by a fluctuation in the charged potential is reduced by correcting the output of the exposure laser to be irradiated with respect to the photosensitive body according to the amount of fluctuation in the charged potential, in correcting the output of the exposure laser, a correction amount of the output of the exposure laser is determined such that, when the charging stop time is shorter than a predetermined reference time, the correction amount of the output of the exposure laser increases as the charging duration in charging the photosensitive body becomes shorter, and in correcting the output of the exposure laser, the correction amount of the output of the exposure laser is determined according to a length of the charging stop time, when the charging stop time is the same as or longer than the predetermined reference time.

* * * * *